US010072550B2

(12) United States Patent
Gehrlein et al.

(10) Patent No.: US 10,072,550 B2
(45) Date of Patent: Sep. 11, 2018

(54) MIXING PIPE ARRANGEMENT WITH HOUSING

(71) Applicant: TENNECO GMBH, Edenkoben (DE)

(72) Inventors: Joachim Gehrlein, Rheinzabern (DE); Frank Terres, Frankeneck (DE); Andreas Lang, Hassloch (DE); Gert Müller, Mannheim (DE)

(73) Assignee: TENNECO GMBH, Edenkoben (DE)

( * ) Notice: Subject to any disclaimer, the term of this patent is extended or adjusted under 35 U.S.C. 154(b) by 163 days.

(21) Appl. No.: 15/105,079

(22) PCT Filed: Dec. 12, 2014

(86) PCT No.: PCT/EP2014/077500
§ 371 (c)(1),
(2) Date: Jun. 16, 2016

(87) PCT Pub. No.: WO2015/091242
PCT Pub. Date: Jun. 25, 2015

(65) Prior Publication Data

US 2016/0312680 A1 Oct. 27, 2016

(30) Foreign Application Priority Data

Dec. 16, 2013 (DE) ..... 10 2013 114 111

(51) Int. Cl.
*F01N 3/28* (2006.01)
*B01F 5/04* (2006.01)
(Continued)

(52) U.S. Cl.
CPC ..... *F01N 3/2892* (2013.01); *B01F 3/04049* (2013.01); *B01F 5/0451* (2013.01);
(Continued)

(58) Field of Classification Search
CPC ..... F01N 3/2892; F01N 13/1888; F01N 13/1894; F01N 2240/20; F01N 2470/02;
(Continued)

(56) References Cited

U.S. PATENT DOCUMENTS 5,832,720 A * 11/1998 Svahn ..... B01D 53/9431 29/890
2003/0079467 A1* 5/2003 Liu ..... B01F 3/04049 60/286
2009/0313979 A1 12/2009 Kowada

FOREIGN PATENT DOCUMENTS

CN 102410069 A 4/2012
CN 202360191 U 8/2012
(Continued)

*Primary Examiner* — Phutthiwat Wongwian
*Assistant Examiner* — Kelsey Stanek
(74) *Attorney, Agent, or Firm* — Hudak, Shunk & Farine Co. LPA

(57) ABSTRACT

A mixer for an exhaust system of an internal combustion engine for mixing additives into an exhaust gas flow, with at least one inlet pipe having a pipe axis, with at least one outlet pipe having a pipe axis and with a housing for receiving the inlet pipe and the outlet pipe, wherein the outlet pipe has an inner part which is arranged within the housing and is provided with at least one outflow opening for the purpose of conducting the exhaust gas out of the housing, wherein the housing has a first housing part with a first housing edge and at least one second housing part with a second housing edge, wherein the two housing parts are at least partially connected via the housing edge, and in that the inlet pipe has an inner part which is arranged within the housing and is provided with at least one inlet opening for the purpose of introducing the exhaust gas into the housing, wherein a) the respective housing edge as at least two formations, each having a center axis, and/or b) the respective housing part has at least two rim holes, each having a center axis, and the
(Continued)

respective pipe has bearing points via which said pipe is mounted within the formations or within the rim holes, wherein i) the respective pipe is formed symmetrically with respect to the design of the bearing points, and, for the purpose of installation, can be mounted in at least two different positions R1, R2 in the respective formation, or ii) the inlet pipe and the outlet pipe are of identical design with respect to the design of the bearing points, or iii) the two housing parts are connectable in a plurality of positions S1, S2 relative to each other via the housing edge.

20 Claims, 5 Drawing Sheets

(51) Int. Cl.

| | |
|---|---|
| ***F01N 13/18*** | (2010.01) |
| ***B01F 5/06*** | (2006.01) |
| ***B01F 3/04*** | (2006.01) |
| *B01F 5/00* | (2006.01) |

(52) U.S. Cl.
CPC ..... *B01F 5/0689* (2013.01); *F01N 13/1888* (2013.01); *F01N 13/1894* (2013.01); *B01F 2005/0091* (2013.01); *F01N 2240/20* (2013.01); *F01N 2470/02* (2013.01); *F01N 2470/04* (2013.01); *F01N 2610/00* (2013.01)

(58) Field of Classification Search
CPC ..... F01N 2470/04; F01N 2610/00; B01F 3/04049; B01F 5/0451; B01F 5/0689
USPC ..... 60/324
See application file for complete search history.

(56) References Cited

FOREIGN PATENT DOCUMENTS

| | | | | | |
|---|---|---|---|---|---|
| CN | 202544986 | U | | 11/2012 | |
| CN | 103174493 | A | | 6/2013 | |
| DE | 20 2007 010 324 | U1 | | 1/2009 | |
| DE | 10 2012 014 334 | A1 | | 5/2014 | |
| EP | 1262644 | A2 | * | 12/2002 | ..... B01D 53/9431 |
| EP | 2 799 682 | A1 | | 11/2014 | |
| NO | 2011 163395 | A1 | | 12/2011 | |
| WO | 2013 099872 | A1 | | 7/2013 | |

* cited by examiner

MIXING PIPE ARRANGEMENT WITH HOUSING

FIELD OF THE INVENTION

The invention relates to a mixer for an exhaust system of an internal combustion engine or of a motor vehicle for mixing liquid and/or gaseous additives into an exhaust gas flow, with at least one inlet pipe having a pipe axis, with at least one outlet pipe having a pipe axis and with a housing for receiving the inlet pipe and the outlet pipe, wherein the outlet pipe has an inner part which is arranged within the housing and is provided with at least one outflow opening for the purpose of conducting the exhaust gas out of the housing.

BACKGROUND OF THE INVENTION

A mixing pipe arrangement with a housing is already known from WO 2011/163395 A1. The arrangement has an inlet pipe as well as an outlet pipe, which are arranged in or on a housing. The inlet pipe hereby runs in a tangential direction to the cylindrically designed housing or the housing wall. The outlet pipe is arranged within the cylindrical housing wall, wherein a center axis of the outlet pipe and a center axis of the housing are arranged in parallel offset from one another. Alternatively, the outlet pipe can also be arranged coaxially to the housing. In another embodiment example, the inlet pipe is arranged coaxially to the housing which is cylindrical in shape, whilst the outlet pipe is located in the radial direction to the housing. The center axis of the inlet pipe and the center axis of the outlet pipe are hereby arranged in one plane. In another embodiment example, the center axis of the inlet pipe and the center axis of the outlet pipe are arranged parallel to one another, wherein the inlet pipe and the outlet pipe are located outside the center of the housing.

A two-shelled exhaust pipe for receiving a mixing nozzle is known from DE 20 2007 010 324 U1. The exhaust pipe has a lower flange for receiving an inflow pipe, wherein an outlet flange of the nozzle serves to receive an outflow pipe.

SUMMARY OF THE INVENTION

The object of the invention is to design and arrange a mixer in such a way that extended variability in terms of use is guaranteed.

The object is achieved according to the invention by the features of Claim 1. As a result, the relative location between the respective pipe and the housing and/or the relative location of the pipes within the housing can be successfully varied. This variation can be achieved as follows:

i) By aligning the inlet pipe or the outlet pipe with respect to the same formation or the same rim hole in a different manner. The inlet pipe or the outlet pipe can optionally be rotated or swiveled by 180°, in order to modify the alignment of the inlet and outlet, consequently the exhaust gas routing. This change of location can only be used for the inlet pipe and/or only for the outlet pipe. The prerequisite is that the respective pipe is formed symmetrically with respect to the bearing points, so that after being swiveled by 180° it can be mounted with the other bearing point respectively in the then corresponding formation or rim hole. The swiveling is effected hereby about an axis a, which extends at right angles to the pipe axis.

ii) By transposing the position of the inlet pipe with the position of the outlet pipe within the housing. In addition to variant i), additional configuration variants of the mixer or the gas routing geometry thereof can be achieved by said transpositions. The center axes of two formations or of two rim holes respectively can therefore be overlapped by the pipe axis of the inlet pipe and by the pipe axis of the outlet pipe, so that the inlet pipe or the outlet pipe can alternatively be mounted with respect to the respective position R1, R2 in the housing shell or in the housing part or in the housing bottom.

iii) By modifying the relative location of the two housing parts or housing shells with respect to one another. In this case, particularly when using rim holes, the gas routing geometry can be achieved independently of the flexible mounting of the pipes in accordance with variants i) and ii). The pipes arranged in the respective shell or in the housing bottom or the associated gas routing geometry is varied with respect to one another by modifying the relative location of the two housing shells or housing walls. Not only can a right angle, i.e. 90°, be considered for the relative positions S1, S2 or the variation angle between the two positions S1, S2, but any angle is possible. The latter with respect to all three spatial axes, i.e. a swivel axis c, which extends parallel to the pipe axis, a swivel axis a, which extends at right angles to the pipe axis, and a swivel axis b, which extends at right angles to the pipe axis and at right angles to the swivel axis a.

The formation of the respective housing edge ensures that the respective pipe is received in each case over a partial circumference of approx. 180°, so that mounting and sealing of the respective pipe over the circumference are guaranteed by the two opposing formations and also in the case of the rim hole.

To this end, it can also be advantageous if two formations or two rim holes respectively have a joint straight center axis. Consequently, a straight inlet pipe and/or a straight outlet pipe can be used to this extent. Regarding this identical form, the two pipes can also be interchanged with respect to their position in the housing.

In addition, it can be advantageous if all formations or all rim holes have the same diameter D. If the two pipes have the same mounting geometry, the identical pipe diameter D guarantees that the two pipes can be interchanged and that the position within the housing can be changed at will.

It can also be advantageous if at least one additional formation having a center axis is provided within the respective housing edge, said center axis being positioned at an angle $\alpha$ with respect to the center axis of the other formation, wherein the inlet pipe or the outlet pipe has a L-shaped, T-shaped or Y-shaped basic form F. Due to the use of another formation, the connection geometry of the mixer can be extended in its entirety.

Three formations are provided in the respective half-shell for the inlet and/or outlet pipe, therefore there are three positions for the connection nozzle itself as well as two positions for the further mounting of the inlet pipe or outlet pipe.

In this case it can be advantageous that the housing edge forming a dividing plane E is formed point-symmetrically with respect to a perpendicular N of the dividing plane E or is formed axisymmetrically with respect to a straight line G of the dividing plane E. Whilst the axisymmetrical form of the housing edge allows a variation of the relative location of the two housing parts in two positions swiveled about 180°, the point-symmetrical form guarantees at least a variation within four positions, i.e. gradually by 90°.

It can be particularly important to this invention, if the housing part has a partially cylindrical basic form F having a center axis b in the region of the housing edge or a partially spherical basic form F having a midpoint M as well as an internal radius ri and an external radius ra, wherein the following rule applies to the ratio between the internal radius ri of the first housing edge and the external radius ra of the second housing edge:

ri>=ra. A partially cylindrical design of the basic form F guarantees a preferably smooth swiveling of the two housing parts about the cylinder axis thus formed. This guarantees an optimum adjustment to the installation space conditions during installation. In addition, the partially spherical basic form F guarantees a preferably smooth relative swiveling of the two housing parts about the midpoint of the sphere, consequently about all three spatial axes. This results in a further optimization in terms of individual adjustment during installation. The fact that the internal radius ri is, at most, the same size as the external radius ra means that the two housing parts have a close sliding fit in the region of the partially cylindrical or partially spherical shape, which close sliding fit guarantees said adjustment of the relative positions about the cylinder axis A, on the one hand, or the midpoint M of the sphere on the other hand.

In connection with the design and arrangement according to the invention, it can be advantageous if the inlet opening and/or the outflow opening is/are formed by one or more recesses which are optionally formed as a swirl flap.

The characteristic of the inlet opening as a perforation in the form of recesses guarantees standardization or homogenization of the gas flow entering the mixer. Regarding the outflow openings of the outlet pipe, the shaping as a swirl flap ensures that the additives introduced into the outlet pipe are mixed well.

It can additionally be advantageous if the inlet opening and/or the outflow opening has/have a hydraulic cross-section Q which varies with respect to the course of the pipe axis. By varying the hydraulic cross-section Q of the inflow or outflow openings, the homogenization of the exhaust gas flow, on the one hand, and the mixing of the additives, on the other hand, are further optimized, with the latter taking place against the backdrop of the fact that the dynamic pressure of the flow varies over the length of the pipe.

Furthermore, it can be advantageous if the hydraulic cross-section Q increases with respect to the direction of flow of the exhaust gas. The increase in the hydraulic cross-section Q facilitates mixing or blending at the end of the mixing chamber.

In addition, it can be advantageous if a mixing element is provided with respect to the direction of flow of the exhaust gas downstream of the outlet pipe. The additional arrangement of a mixing element guarantees a further optimization of the entry of the additive into the gas flow. In addition, the additional mixing element guarantees time-delayed admixing of an additional additive.

In this case, it can be advantageous if an additive supply unit for introducing the additive into the housing or into the inlet pipe or into the outlet pipe is provided. Preferably, the additive is first mixed in the outlet pipe, after the exhaust gas flow has been standardized via the inlet pipe and, in this respect, enters the inlet pipe symmetrically.

Finally, it can be advantageous if the inlet pipe or outlet pipe has a conical design. The conical design of the inlet and/or outlet pipe guarantees further influencing of the flow ratio, particularly considering the hydraulic cross-section Q of the perforation or the swirl flaps. As a result of tapering of the pipe, the gas flow or the dynamic pressure of the gas increases which, in turn, results in an increase in the flow passing through the perforation or the swirl flaps.

To this end, it can also be advantageous if the first housing part and the second housing part are designed as the housing shell or as the housing bottom respectively, wherein a housing casing is provided, which forms the housing together with the respective bottom. The installation is simplified as a whole by using housing shells. In this case, the housing consists of just two components which, due to the connection geometry of the housing edge, can, as previously described, be aligned in different relative positions to one another and can be connected. Overlapping this variation, the inlet and outlet pipes can be varied within the formations or rim holes, which all in all guarantees a very simple construction and a multitude of possible variations.

The design of the housing as a winding housing, i.e. the use of housing bottoms and a housing casing, also guarantees the possible variations indicated above with respect to the relative location of the housing parts, on the one hand, and the pipes, on the other hand. The housing itself then consists of at least three components, which are to be connected according to the desired location.

The housing can be produced in accordance with any production methods such as, for example, as a shell housing or also as a winding housing.

BRIEF DESCRIPTION OF THE DRAWINGS

Further advantages and details of the invention are explained in the claims and in the specification, and illustrated in the figures, wherein:

DETAILED DESCRIPTION OF THE INVENTION

Figure 1A:
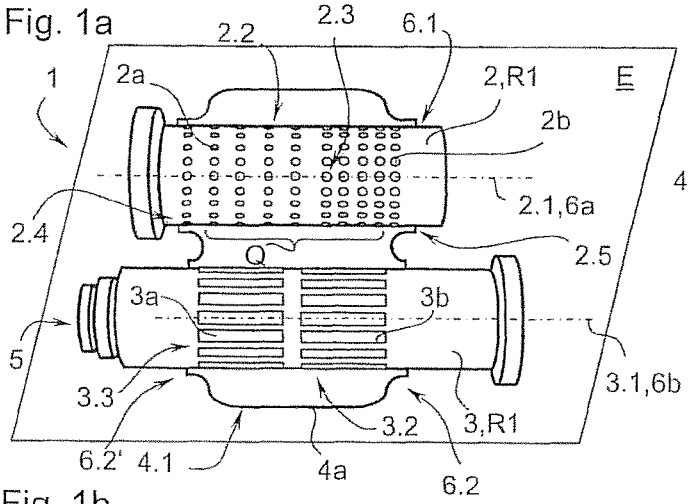
FIG. 1*a* shows a partial view of the mixer 1 with the inlet pipe and outlet pipe 2, 3 in the lower housing shell 4.1.

A mixer 1 shown in FIG. 1*a* has a housing 4 with a first housing part 4.1 designed as a housing shell, in which housing part four formations 6.1, 6.1', 6.2, 6.2' are provided, wherein an inlet pipe 2 is arranged in a position R1 in the formations 6.1, 6.1' and an outlet pipe 3 is arranged in the position R1 in the formations 6.2, 6.2'. The respective pipe 2, 3 has bearing points 2.4, 2.5, 3.4, 3.5, via which said pipe is mounted in the respective formation. In accordance with FIG. 2*a*, the mixer 1 is sealed by a second housing part 4.2 which is also designed as a housing shell, which is not shown in the illustration in accordance with FIG. 1*a*. The housing part 4.2 has the corresponding formations 6.3, 6.4, 6.3', 6.4'. The inlet pipe 2 has a plurality of recesses 2*a*, 2*b* designed as a perforation in the region of an inner part 2.2, wherein a hydraulic cross-section Q of the perforation 2*a* is smaller than that of the perforation 2*b*. For the purpose of connection to an exhaust pipe which is not shown in more detail, the inlet pipe 2 is routed outwardly via the respective formation 6.1, 6.3. In addition, the outlet pipe 3 is mounted via the recesses 6.2, 6.4 and also has an outflow opening 3.3 in the region of an inner part 3.2. The outflow opening 3.3 is formed from a plurality of recesses 3*a*, 3*b* which are, in turn, designed as a swirl flap. An injection nozzle 5 for additives as well as a further mixing element 8 are provided outside the housing 4.

Figure 2A:
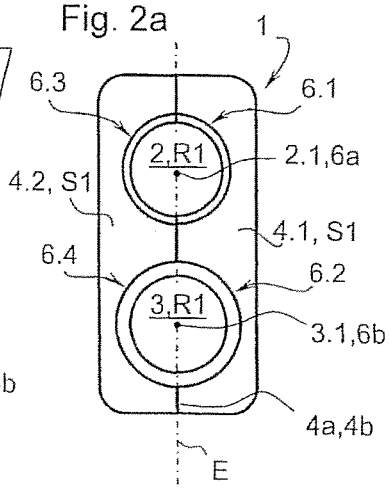
FIG. 2*a* shows a lateral view of the mixer 1 in accordance with FIG. 1 with the two housing shells 4.1, 4.2.

For the purpose of connecting the first housing shell 4.1, said housing shell has a first housing edge 4*a* which can be brought at least partially into contact in accordance with FIG. 2*a* with a housing edge 4*b* of the second housing shell 4.2. At the point where the housing edges 4*a*, 4*b* can be brought into contact opposite one another, these form a dividing plane E for the housing 4. Both the inlet pipe 2 and the outlet pipe 3 have pipe axes 2.1, 3.1 which are aligned coaxially to a center axis 6*a*, 6*b* of the respective pair of formations 6.1, 6.3 and 6.2, 6.4.

Figure 1B:
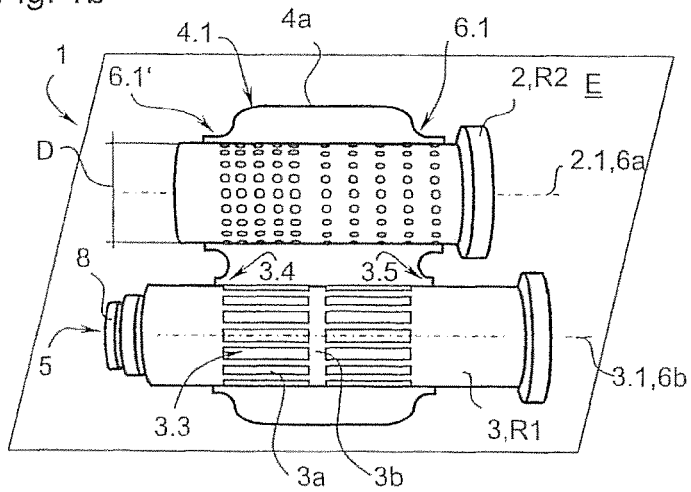
FIG. 1*b* shows a view in accordance with FIG. 1*a* with a rotated arrangement of the inlet pipe 2.
Figure 2B:
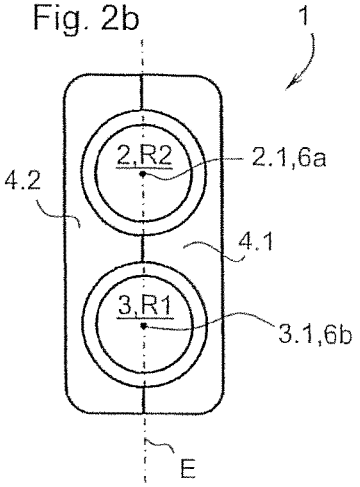
FIG. 2*b* shows a lateral view in accordance with FIG. 1*b;*

According to the embodiment example in accordance with FIG. 1*b*, the inlet pipe 2, in contrast to the embodiment in accordance with FIG. 1*a*, is rotated by 180°. The inlet pipe 2 is located in a position R2, whilst the outlet pipe 3 remains in the position R1. The inlet pipe 2 has diameters D of the same size, in the region of its bearing points 2.4, 2.5, i.e. in the region of the respective formation 6.1, 6.3, so that said inlet pipe can easily be rotated by 180°. The two housing shells 4.1, 4.2 remain in the same relative position S1 to one another in accordance with FIG. 2*b*. The same can also be used for the outlet pipe.

It is also possible in principle for the outlet pipe 3 and/or the two pipes 2, 3 to be swiveled or rotated, in order to take account of the respective installation conditions.

Figure 3A:
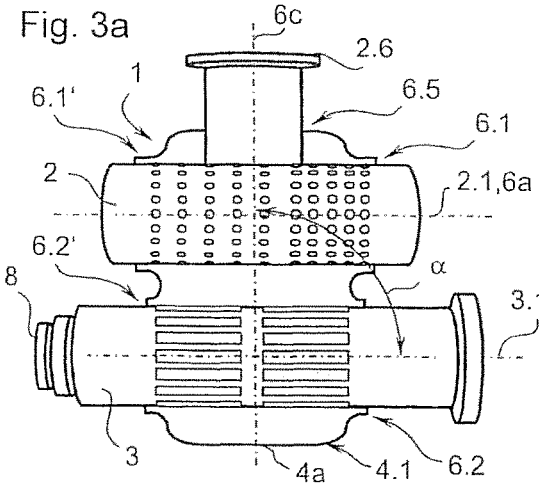
FIG. 3*a* shows another embodiment in a partial view in accordance with FIG. 1*a*, 1*b* with an additional formation 6.5 for the inlet pipe 2.

According to the embodiment in accordance with FIG. 3*a*, the housing 4 has one additional formation 6.5 which is merely shown here in the first housing shell 4.1. The inlet pipe 2 is mounted in this embodiment both in the formations 6.1, 6.3 and in the formation 6.5. It is T-shaped in its basic form and has, in addition to the perforated inner part 2.2, a connection nozzle 2.6 having a center axis 6*c* which is routed externally via the formation 6.5.

Figure 3B:
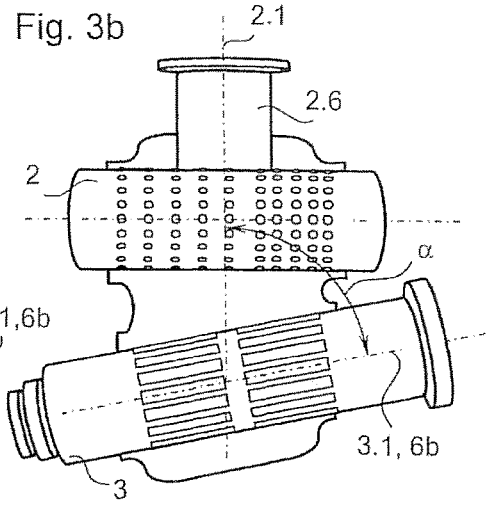
FIG. 3*b* shows another embodiment in a partial view in accordance with FIG. 3*a* with positioning of the outlet pipe 3 about the angle α.

According to the embodiment example in accordance with FIG. 3*b*, the center axis 6*b* of the formations 6.2, 6.4 is positioned opposite the center axis 6*a* at an angle α. For the purpose of adjusting to the installation situation, swiveling of the inlet pipe or outlet pipe 2, 3 in the housing 4 or within the respective housing shell 4.1, 4.2 can, in particular, be guaranteed.

According to the embodiment example in accordance with FIGS. 4*a* to 11*b*, the pipes 2, 3 are mounted, unlike the embodiment examples in accordance with FIG. 1*a* to FIG. 3*b*, within rim holes 7.1, 7.2, 7.3, 7.4 in the respective housing shell 4.1, 4.2. As can be seen in FIG. 5*a*, the inlet pipe 2 is arranged in the lower housing shell 4.2, whilst the outlet pipe 3 is located in the upper housing shell 4.1. Both the upper housing shell 4.1 and the lower housing shell 4.2 are respectively located in a position S1. The center axes 7*a*, 7*b* of the rim holes are arranged coaxially to the pipe center axes 2.1, 3.1.

The inlet pipe 2 is mounted within the rim holes 7.2, 7.4, whilst the outlet pipe 3 is mounted within the rim holes 7.1, 7.3. The two housing parts 4.1, 4.2 have, in turn, a housing edge 4*a*, which is not shown in more detail, which forms the dividing plane E. This housing edge 4*a* is formed axisymmetrically with respect to a straight line G and has a basic form F which is shown here by way of example as being rectangular. Due to this basic form F, as can be seen in the embodiment example in accordance with FIG. 4*b* in conjunction with FIG. 5*b*, the two housing shells 4.1, 4.2 can be swiveled by 180°, whilst the inlet pipe and the outlet pipe 2, 3 remain in the respective shell 4.2, 4.1.

Figure 4A:
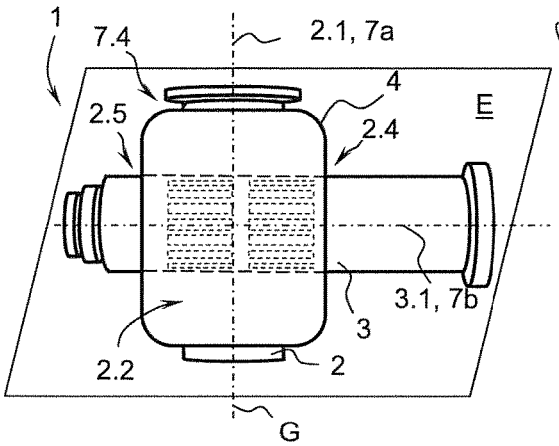
FIGS. 4*a, b* show a perspective view of the mixer 1 from above with an axisymmetrical configuration of the housing flanges 4*a*, 4*b* and the outlet pipe 3 in a rotated configuration.
Figure 5A:
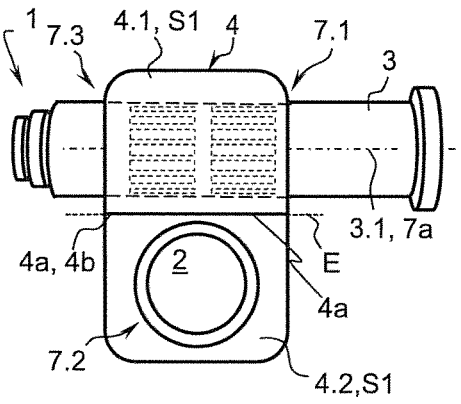
FIGS. 5*a, b* show a lateral view in accordance with FIGS. 4*a, b;*
Figure 4B:
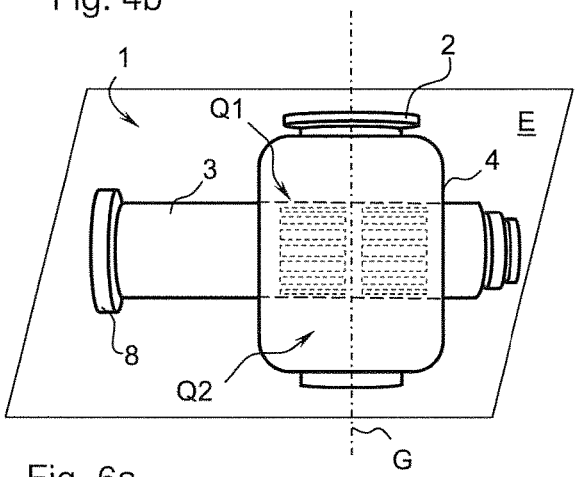
Figure 5B:
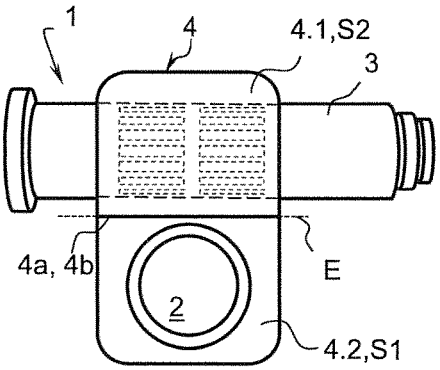

In accordance with FIG. 4*b*, 5*b*, the housing shell 4.1, starting from the embodiment in FIG. 4*a*, 5*a*, has been swiveled from the position S1 into the position S2.

Figure 6A:
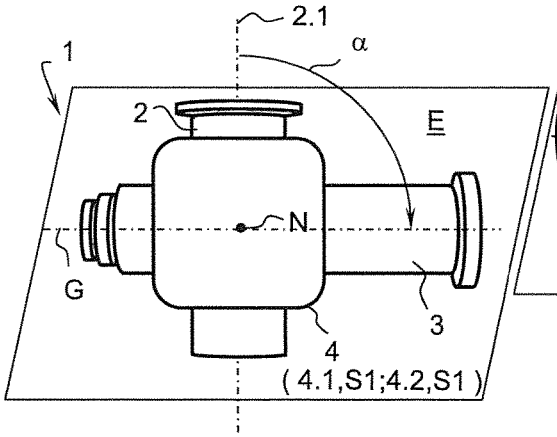
FIGS. 6*a, b* show an embodiment example in accordance with FIGS. 4*a, b*, but with a point-symmetrical configuration of the housing flanges 4*a*, 4*b* and the inlet pipe 3 in a swiveled configuration.

According to the embodiment example in accordance with FIG. 6*a*, the housing edge 4*a*, which is not shown in more detail, is square, and is therefore formed point-symmetrically with respect to a perpendicular N of the dividing plane E, so that the two housing shells 4.1, 4.2 can be swiveled by 90°. According to the embodiments in accordance with FIG. 6*a*, 6*b*, the swiveling is effected towards the right by 90°. Further swiveling possibilities accordingly by 180° or 270° or 90° are of course also possible.

In accordance with FIG. 6*a*, the first housing shell 4.1 is located in the position S1 and the second housing shell 4.2 is located in the position S1. In the embodiment in accordance with FIG. 6*b*, the first housing shell 4.1 is located in a position S2 and the second housing shell 4.2 is located in the position S1. Consequently, the two housing shells 4.1, 4.2 are swiveled by the angle α by 90°.

Figure 6B:
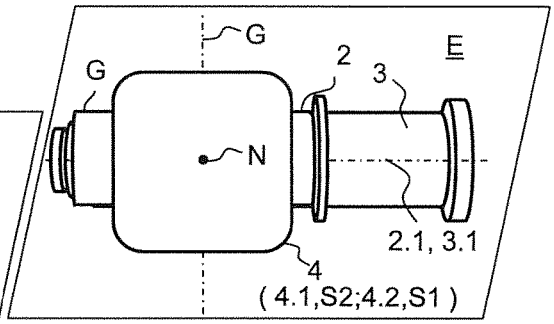
Figure 7A:
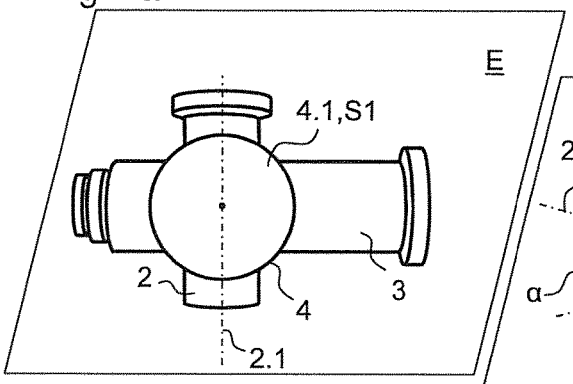
FIGS. 7*a, b* show a further embodiment of the point-symmetrical configuration with circular housing flanges 4*a*, 4*b* in various positions S1, S2.
Figure 7B:
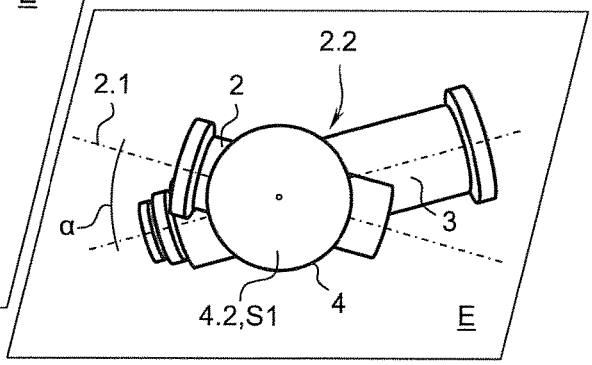
Figure 8A:
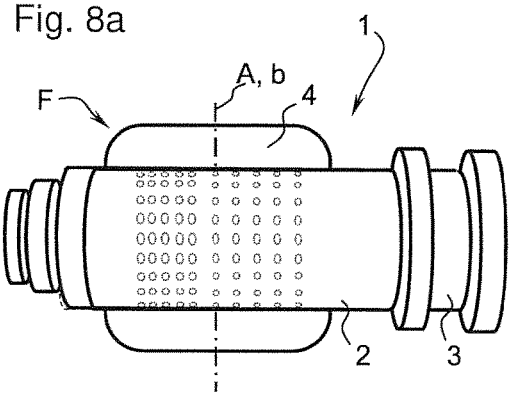
FIGS. 8*a, b* show an embodiment with a partially cylindrical basic form F in the view from above with a swivel angle β.
Figure 9A:
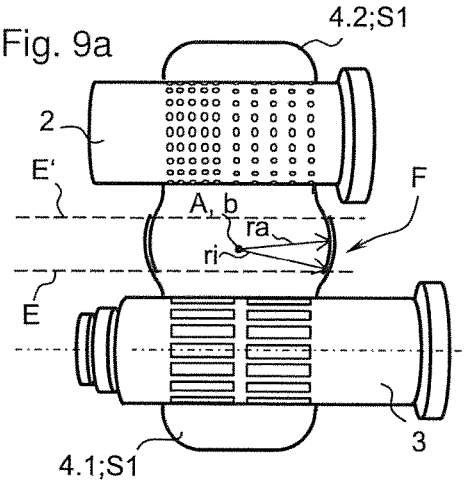
FIGS. 9*a, b* show a cross-sectional view in accordance with FIG. 8*a, b;*
Figure 8B:
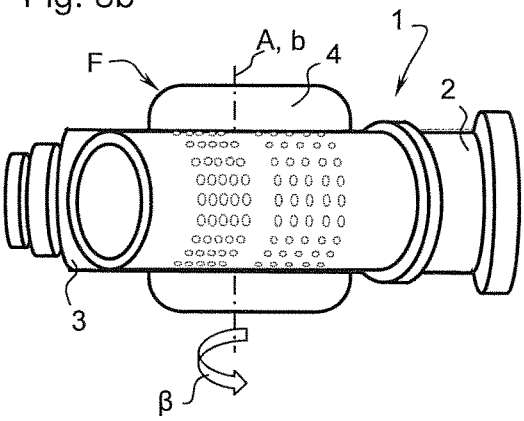
Figure 9B:
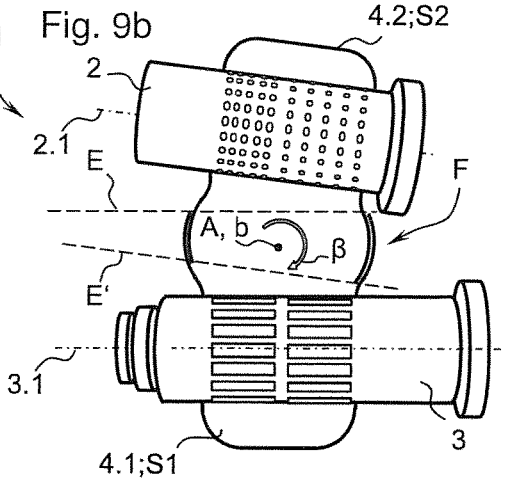

According to the embodiment in accordance with FIGS. 7*a*, 7*b*, the housing 4 or the edge 4*a* is not square, as shown in FIGS. 6*a*, 6*b*, but is designed to be circular. Due to the circular design, the two housing shells 4.1, 4.2 can be swiveled by any angle α.

According to the embodiment example in accordance with FIGS. 8*a*, 8*b* or FIGS. 9*a*, 9*b*, the housing shell 4.1, 4.2 has a partially cylindrical basic form F with a cylinder axis A in the region of the respective housing edge 4*a*, 4*b*. The first housing shell 4.1 has an external radius ra, which is greater or equal to an internal radius ri of the second housing shell 4.2, resulting in a cylindrical close sliding fit between the two housing shells 4.1, 4.2. Thanks to this close sliding fit, the two housing shells 4.1, 4.2 can be smoothly swiveled relative to one another by an angle β. There is no longer a joint dividing plane E. Rather, each housing shell 4.1, 4.2 has a connection plane E, E' which is spanned by the housing edge.

Figure 10A:
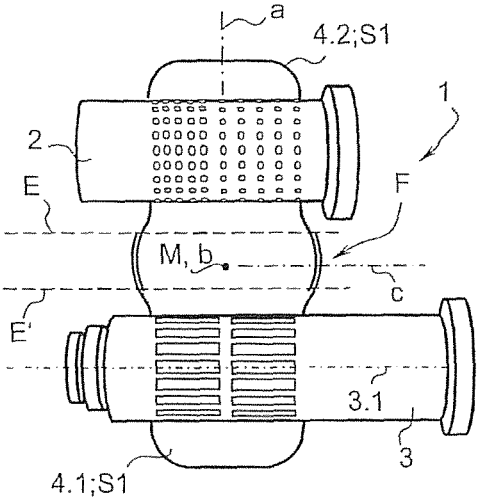
FIGS. 10*a, b* show an embodiment with a partially spherical basic form F in the cross-sectional view and application of the swivel angles α and β.
Figure 11A:
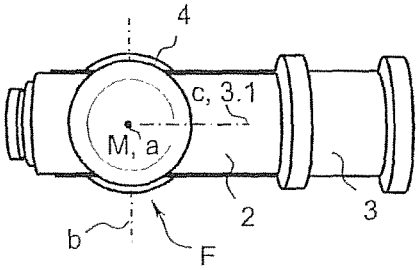
FIGS. 11*a, b* show a view in accordance with FIGS. 10*a, b* from above.
Figure 10B:
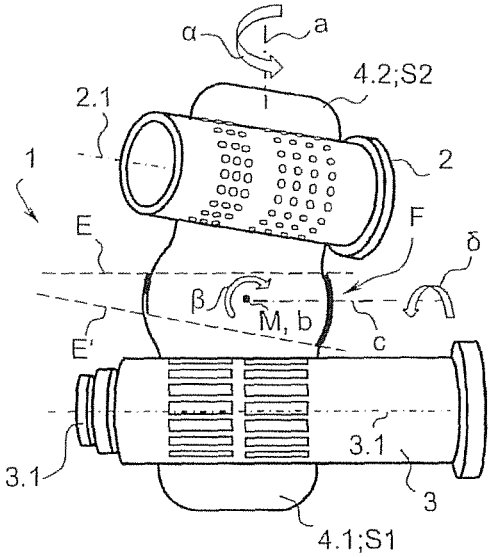
Figure 11B:
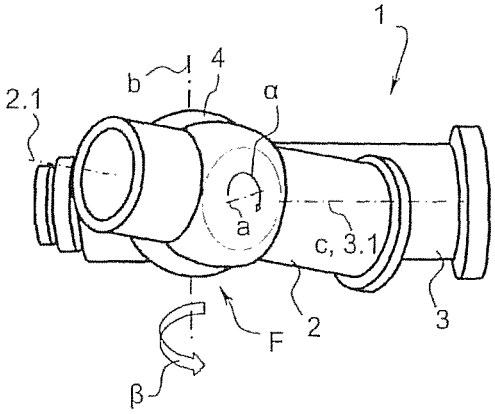

According to the embodiment examples in accordance with FIGS. 10*a*, 10*b* as well as FIGS. 11*a*, 11*b*, the two housing shells 4.1, 4.2 have a partially spherical basic form F having a midpoint M in the region of the housing edge 4*a*, 4*b*. The partially spherical basic form F of the first housing shell 4.1 has an external radius ra, which is greater or equal to the internal radius ri of the second housing shell 4.2. This produces a partially spherical close sliding fit having a midpoint M between the two housing shells 4.1, 4.2. As can be seen in the embodiment in accordance with FIGS. 10*b*, 11*b*, the two housing shells 4.1, 4.2 can both be smoothly swiveled relative to one another both by the angle α and by the angles β and δ, i.e. about all three spatial or swiveling axes a, b, c. Swiveling about the swivel axis c or by the angle δ is not shown.

Figure 12A:
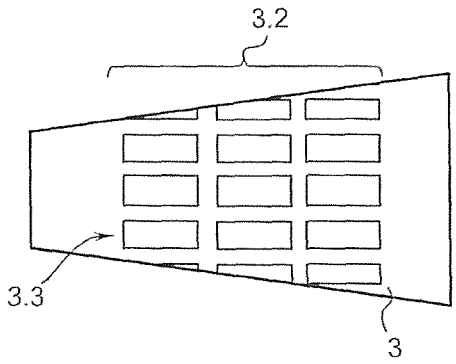
FIGS. 12*a, b* show an inlet and an outlet pipe 2, 3 in a conical configuration.
Figure 12B:
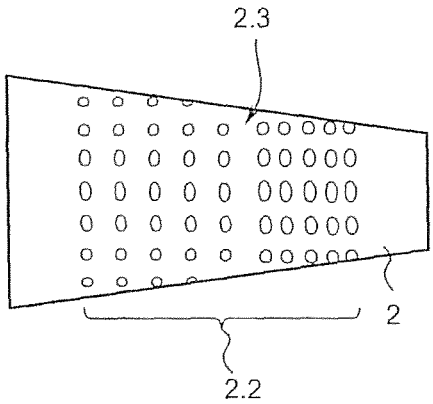

According to the embodiment in accordance with FIGS. 12*a*, 12*b*, the inlet pipe 2 or the outlet pipe 3 is designed with a conical basic form F, wherein an inlet opening 2.3 or the outlet opening 3.3 is limited to the respective inner part 2.2, 3.2.

Figure 13:
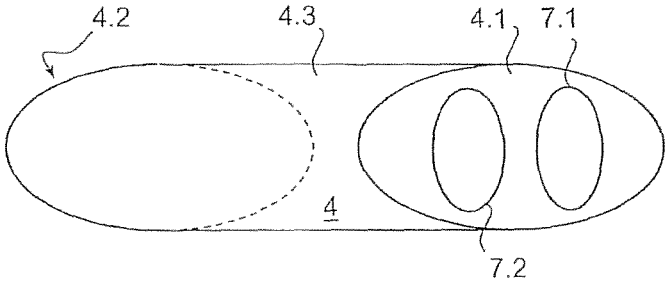
FIG. 13 shows an embodiment as a winding housing.

According to the embodiment in accordance with FIG. 13, the housing 4 is designed as a winding housing with a first and a second housing bottom 4.1, 4.2 as well as a housing casing 4.3. Similarly to the embodiment in accordance with FIG. 1*a*, both the inlet pipe and the outlet pipe 2, 3 can be arranged within the rim holes 7.1, 7.2. The respective position R1, R2 can also be exchanged.

Figure 14:
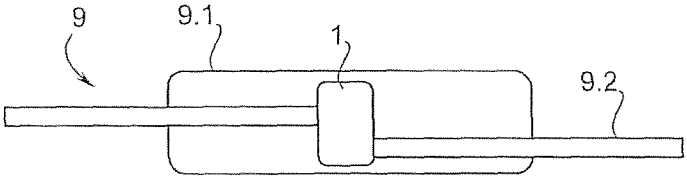
FIG. 14 shows an exhaust system 9 with an integrated mixer 1.

In accordance with FIG. 14, an exhaust system 9 having a muffler housing 9.1 and an exhaust pipe 9.2 is provided, wherein the mixer 1 is completely integrated into the muffler housing 9.1.

LIST OF REFERENCE NUMERALS

1. Mixer
2 Inlet pipe
2.1 Pipe axis
2.2 Inner part
2.3 Inlet opening, perforation
2.4 Bearing point
2.5 Bearing point
2.6 Connection nozzle
2*a* Recess
2*b* Recess
3 Outlet pipe
3.1 Pipe axis
3.2 Inner part
3.3 Outflow opening
3.4 Bearing point
3.5 Bearing point
3*a* Recess, swirl flap
3*b* Recess, swirl flap
4 Housing
4.1 First housing part, first housing shell, first housing bottom
4*a* First housing edge, connection flange
4.2 Second housing part, second housing shell, second housing bottom
4*b* Second housing edge, connection flange
4.3 Housing casing
5 Additive supply unit, injection nozzle
6.1 Formation
6.1' Formation
6.2 Formation
6.3 Formation
6.4 Formation
6.5 Formation
6*a* Center axis
6*b* Center axis
6*c* Center axis
7.1 Rim hole
7.2 Rim hole
7.3 Rim hole
7.4 Rim hole
7*a* Center axis
7*b* Center axis
8 Mixing element
9 Exhaust system
9.1 Muffler
9.2 Exhaust pipe
α Angle
β Angle
δ Angle
A Cylinder axis
a Swivel axis
b Swivel axis; center axis
c Swivel axis
D Diameter
E Dividing plane, connection plane
E' Connection plane
F Basic form of 4*a*, 4*b*
G Straight line of E
M Midpoint
N Perpendicular to E
Q Cross-section, hydraulic
R1 Position
R2 Position
ri Internal radius of F
ra External radius of F
S1 Position
S2 Position

What is claimed is:

1. A mixer for an exhaust system of an internal combustion engine for mixing additives into an exhaust gas flow, comprising: at least one inlet pipe having a pipe axis, with at least one outlet pipe having a pipe axis and with a housing for receiving the inlet pipe and the outlet pipe, wherein the outlet pipe has an inner part which is arranged within the housing and is provided with at least one outflow opening for the purpose of conducting the exhaust gas out of the housing, wherein the housing has a first housing part with a first housing edge and at least one second housing part with a second housing edge, wherein the at least two housing parts are at least partially connected via the first housing edge and the second housing edge, and wherein the inlet pipe has an inner part which is arranged within the housing and is provided with at least one inlet opening for the purpose of introducing the exhaust gas into the housing, wherein one or more of a) the first housing edge and the second housing edge have at least two formations each having a center axis, and b) the first housing part and the second housing part have at least two rim holes, each having a center axis, and the inlet pipe and the outlet pipe have bearing points via which the inlet pipe or the outlet pipe is mounted within the formations or within the rim holes, wherein i) the inlet pipe and the outlet pipe are formed symmetrically with respect to the design of the bearing points and, for the purpose of installation, can be mounted in at least two different positions (R1, R2) in the respective formation or ii) the inlet pipe and the outlet pipe are of identical design with respect to the design of the bearing points, or iii) the first housing part and the second housing part are connectable in a plurality of positions (S1, S2) relative to each other via the first housing edge and the second housing edge.

2. The mixer according to claim 1, wherein two formations or the at least two rim holes each have a joint straight center axis.

3. The mixer according to claim 2, wherein at least one additional formation having a center axis is provided within the first housing edge and the second housing edge, said center axis being positioned at an angle (α) with respect to the center axis of at least one of the at least two formations, wherein the inlet pipe or the outlet pipe has a L-shaped, T-shaped or a Y-shaped basic form, wherein the first housing edge and the second housing edge form a dividing plane E formed point-symmetrically with respect to a perpendicular (N) of the dividing plane (E) or formed axisymmetrically with respect to a straight line (G) of the dividing plane (E), and wherein the first housing part and the second housing part have a partially cylindrical basic form having a center axis (b) or a partially spherical basic form having a midpoint (M) as well as an internal radius (ri) and an external radius (ra) in the region of the first housing edge and the second housing edge, wherein the rule (ri)>=(ra) applies to the ratio between the internal radius (ri) of the first housing edge and the external radius (ra) of the second housing edge.

4. The mixer according to claim 3, wherein one or more of the inlet opening and the outflow opening is/are formed by one or more recesses which are optionally formed as a swirl flap, wherein one or more of the inlet opening and the outflow opening has/have a hydraulic cross-section (Q1, Q2) which varies with respect to the course of the pipe axis of the inlet pipe or the pipe axis of the outlet pipe, and wherein the hydraulic cross-section (Q1, Q2) increases with respect to a direction of flow of the exhaust gas.

5. The mixer according to claim 1, wherein all formations or all rim holes have the same diameter (D).

6. The mixer according to claim 5, wherein at least one additional formation having a center axis is provided within the first housing edge and the second housing edge, said center axis being positioned at an angle (α) with respect to the center axis of at least one of the at least two formations, wherein the inlet pipe or the outlet pipe has a L-shaped, T-shaped or a Y-shaped basic form, wherein the first housing edge and the second housing edge form a dividing plane (E) formed point-symmetrically with respect to a perpendicular (N) of the dividing plane (E) or formed axisymmetrically with respect to a straight line (G) of the dividing plane (E), and wherein the first housing part and the second housing part have a partially cylindrical basic form having a center axis (b) or a partially spherical basic form having a midpoint (M) as well as an internal radius (ri) and an external radius (ra) in the region of the first housing edge and the second housing edge, wherein the rule (ri)>=(ra) applies to the ratio between the internal radius (ri) of the first housing edge and the external radius diameter (ra) of the second housing edge.

7. The mixer according to claim 6, wherein one or more of the inlet opening and the outflow opening is/are formed by one or more recesses which are optionally formed as a swirl flap, wherein one or more of the inlet opening and the outflow opening has/have a hydraulic cross-section (Q1, Q2) which varies with respect to the course of the pipe axis of the inlet pipe or the pipe axis of the outlet pipe, and wherein the hydraulic cross-section (Q1, Q2) increases with respect to a direction of flow of the exhaust gas.

8. The mixer according to claim 7, wherein a mixing element is provided with respect to a direction of flow of the exhaust gas downstream of the outlet pipe, wherein an additive supply unit for introducing an additive into the housing or into the inlet pipe or into the outlet pipe is provided, wherein the inlet pipe or outlet pipe has a conical design, and wherein the first housing part and the second housing part are designed:

a) as a housing shell or b) as a housing bottom, wherein a housing casing is provided, which forms the housing together with the at least two housing parts.

9. The mixer according to claim 1, wherein at least one additional formation having a center axis is provided within the first housing edge and the second housing edge, said center axis being positioned at an angle with respect to the center axis of at least one of the at least two formations, wherein the inlet pipe or the outlet pipe has a L-shaped, T-shaped or a Y-shaped basic form.

10. The mixer according to claim 1, wherein the first housing edge and the second housing edge form a dividing plane (E) formed point-symmetrically with respect to a perpendicular (N) of the dividing plane (E) or formed axisymmetrically with respect to a straight line (G) of the dividing plane (E).

11. The mixer according to claim 10, wherein the first housing part and the second housing part have a partially cylindrical basic form having a center axis (b) or a partially spherical basic form having a midpoint (M) as well as an internal radius (ri) and an external radius (ra) in the region of the first housing edge and the second housing edge, wherein the rule (ri)>=(ra) applies to the ratio between the internal radius (ri) of the first housing edge and the external radius (ra) of the second housing edge.

12. The mixer according to claim 1, wherein one or more of the inlet opening and the outflow opening is/are formed by one or more recesses which are optionally formed as a swirl flap.

13. The mixer according to claim 1, wherein one or more of the inlet opening and the outflow opening has/have a hydraulic cross-section (Q1, Q2) which varies with respect to the course of the pipe axis of the inlet pipe or the pipe axis of the outlet pipe.

14. The mixer according to claim 13, wherein the hydraulic cross-section (Q1, Q2) increases with respect to a direction of flow of the exhaust gas.

15. The mixer according to claim 1, wherein a mixing element is provided with respect to a direction of flow of the exhaust gas downstream of the outlet pipe.

16. The mixer according to claim 1, wherein an additive supply unit for introducing an additive into the housing or into the inlet pipe or into the outlet pipe is provided.

17. The mixer according to claim 1, wherein the inlet pipe or outlet pipe has a conical design.

18. The mixer according to claim 1, wherein the first housing part and the second housing part are designed a) as a housing shell or b) as a housing bottom, wherein a housing casing is provided, which forms the housing together with the at least two housing parts.

19. A system consisting of an exhaust system of an internal combustion engine having a mixer according to claim 1.

20. The system according to claim 19, wherein a muffler housing is provided, wherein the mixer is at least partially integrated into the muffler housing.

* * * * *